US007449044B2

(12) United States Patent
Asai et al.

(10) Patent No.: US 7,449,044 B2
(45) Date of Patent: Nov. 11, 2008

(54) METHOD AND APPARATUS FOR PRODUCING METAL POWDER

(75) Inventors: Tsuyoshi Asai, Chigasaki (JP); Takuya Miyagi, Chigasaki (JP)

(73) Assignee: Toho Titanium Co., Ltd., Chigasaki-shi (JP)

( * ) Notice: Subject to any disclaimer, the term of this patent is extended or adjusted under 35 U.S.C. 154(b) by 523 days.

(21) Appl. No.: 10/528,372

(22) PCT Filed: Sep. 12, 2003

(86) PCT No.: PCT/JP03/11717

§ 371 (c)(1),
(2), (4) Date: Mar. 18, 2005

(87) PCT Pub. No.: WO2004/030853

PCT Pub. Date: Apr. 15, 2004

(65) Prior Publication Data

US 2006/0162496 A1 Jul. 27, 2006

(30) Foreign Application Priority Data

Sep. 30, 2002 (JP) ..... 2002-285309

(51) Int. Cl.
*B22F 9/28* (2006.01)

(52) U.S. Cl. ..... 75/367; 75/369

(58) Field of Classification Search ..... 75/367, 75/369

See application file for complete search history.

(56) References Cited

U.S. PATENT DOCUMENTS

| | | | | |
|---|---|---|---|---|
| 4,284,394 | A * | 8/1981 | Thompson | 425/8 |
| 5,472,477 | A | 12/1995 | Konig | |
| 6,235,077 | B1 * | 5/2001 | Kagohashi et al. | 75/369 |
| 6,372,015 | B1 | 4/2002 | Asai et al. | |

FOREIGN PATENT DOCUMENTS

| | | |
|---|---|---|
| CN | 1051002 | 5/1991 |
| CN | 1214643 | 4/1999 |
| FR | 2 591 412 | 6/1987 |
| JP | 59-7765 | 2/1984 |
| JP | 4-365806 | 12/1992 |
| JP | 5-163513 | 6/1993 |
| JP | 5-247506 | 9/1993 |
| JP | 11-350010 A | 12/1999 |
| JP | 2000-345216 | 12/2000 |
| JP | 2000-345217 | 12/2000 |
| JP | 2001-89804 | 4/2001 |
| JP | 2001-261335 | 9/2001 |

* cited by examiner

*Primary Examiner*—George Wyszomierski
(74) *Attorney, Agent, or Firm*—Antonelli, Terry, Stout & Kraus, LLP.

(57) ABSTRACT

An object of the present invention is to provide a method for production of metallic powder in which aggregation of particles and growth to secondary particle after reducing process of the metallic powder particle can be prevented, to reliably obtain metallic particles containing few coarse particles and to meet requirements of thinner layer and greater number of layers in recent capacitors, and a production device therefor. The present invention includes a reducing process in which metal chloride gas and reducing gas are contacted to continuously reduce the metal chloride, and a cooling process in which a gas containing metallic powder generated in the reducing process is continuously cooled by inert gas. In the cooling process, a vortex flow is generated by blowing out the inert gas from at least one part around the flowing passage of the metallic powder. Furthermore, during the production of the metallic powder, inert gas flow is generated in the vertical direction along the inner wall of the production device (reducing process and cooling process) continuously. Aggregation of the metallic powder and growth of secondary particles can be reduced to reliably obtain metallic powder having uniform particle size containing few coarse particles.

21 Claims, 5 Drawing Sheets

METHOD AND APPARATUS FOR PRODUCING METAL POWDER

TECHNICAL FIELD

The present invention relates to a method for production of metallic powders, such as those of nickel, copper, silver, or the like, which are suitable for various purposes such as for conductive paste filler for electronic parts or the like, bonding materials for titanium materials, and catalysts, and in particular, relates to a technique for production of metallic powder to consistently obtain metallic particles which contain few coarse particles such as aggregated particles, and which fulfills the requirements for thinner layers and increased number of layers in recent capacitors.

BACKGROUND ART

A conductive metallic powder such as one of nickel, copper, silver, or the like is appropriate for internal electrodes of multilayered ceramic capacitors, and in particular, nickel powder has attracted much attention for use in this way. In particular, nickel ultrafine powder produced by a dry-type production reaction method is very promising. Accompanied by reduction in size and capacity-increase of capacitors, internal electrodes are required to have thin layers and to have less resistance, development of ultrafine powder having particle diameters of not more than 0.5 μm, as well as particle diameters of not more than 1 μm, is required.

Conventionally, several kinds of methods for production of such ultrafine particle metallic powder have been suggested. For example, in Japanese Unexamined Patent Application Publication No. Sho 59-7765, a method for production of spherical nickel ultrafine powder having an average diameter of from 0.1 to several micrometers, in which solid nickel chloride is heated and vaporized to nickel chloride gas, and hydrogen gas is blown into this gas at high-speed to cause nucleation growth at the chaotic interface, is disclosed.

Furthermore, in Japanese Unexamined Patent Application Publication No. Hei 04-365806, a technique in which solid nickel chloride is evaporated to obtain nickel chloride gas having a partial pressure in a range of from 0.05 to 0.3, and the gas is reduced in the gas phase at 1004° C. to 1453° C., is disclosed. In this method, since the reduction reaction is performed at about 1000° C. or more, metallic powder particles generated may easily aggregate to grow to form secondary particles in the temperature of reduction process or other later processes. As a result, desired ultrafine metallic powder cannot be reliably obtained.

Furthermore, in Japanese Unexamined Patent Application Publication No. Hei 11-350010, a technique in which metallic powder generated by contacting metal chloride gas and reducing gas is contacted with inert gas and rapidly cooled at a rate of 30° C./sec or more to 800° C., to restrain aggregation of metallic powder particles and growth of secondary particles. In this method, aggregation and growth of secondary particles of metallic powder particles can be restrained, and ultrafine metallic powder can be obtained.

However, accompanied by reduction in size and capacity increase of capacitors, thinning of layers and increase in number of layers are required for recent capacitors. Therefore, by the above-mentioned technique disclosed in the publication No. Hei 11-350010, effects to inhibit aggregation of metallic powder particles and growth of secondary particles are not sufficient, and it is difficult to reliably produce metallic powder having uniform particle size and not having coarse particles.

Furthermore, if the metallic powder produced adheres to inner wall of the reducing furnace in which metal chloride gas and reducing gas are contacted or an inner wall of the cooling device in which the metallic powder generated at the reducing process is rapidly cooled, the metallic powder may grow to form coarse particles, or adhered metallic particles may aggregate to form secondary particles to form coarse particles, and the coarse particles may be mixed in a finished product.

As a technique to prevent aggregation and growth of the metallic powder which is adhered on an inner wall of metallic powder producing device, a technique in which production of metallic powder is periodically stopped and adhering material inside the device is removed mechanically, is disclosed in Japanese Unexamined Patent Application Publication No. Hei 5-163513. Furthermore, a production device for metallic magnetic powder having a removing means in which metallic magnetic powder adhered to a reaction container wall of the metallic magnetic powder is removed without opening the reaction container, is disclosed in Japanese Unexamined Patent Application Publication No. Hei 5-247506.

In the publication No. Hei 5-247506, as a method of removing adhering magnetic powder, a method in which adhering powder is blown off by blowing inert gas, a method in which adhering powder is blown and falled by blowing metallic powder or ceramic powder together with the inert gas, a method in which impact is given to a reaction container from the outside, and the like are disclosed.

However, these methods are methods which require periodic stopping during production to remove adhered powder as is similar to the method disclosed in the publication No. Hei 5-163513. Therefore, adhering of the metallic powder on the inner wall of the device during the production cannot be prevented completely, and mixing of coarse particles in the metallic powder product cannot be prevented completely. Since the production must be periodically stopped, deterioration of productivity is unavoidable.

DISCLOSURE OF THE INVENTION

Therefore, the present invention was completed in view of the above-described circumstances, and objects of the present invention are to provide a method for production of metallic powder in which aggregation of particles and growth of secondary particles after reducing process of the metallic powder particle produced by a gas-phase reducing method, which is a reaction of metal chloride gas and reducing gas, can be prevented, to reliably obtain metallic particles containing few coarse particles, and to meet the requirements of thinner layers and increased number of layers for recent capacitors, and a production device therefor.

Regarding a technique to produce metallic powder by the gas-phase reducing method, the following facts are known. That is, in the producing process of the metallic powder by the gas-phase reducing reaction, a metal atom is generated at the moment in which metal chloride gas and reducing gas are collided, the metal atoms are mutually collided and aggregated to form an ultrafine particle, and the ultrafine particle grows. The particle diameter of the metallic powder generated is determined by conditions such as partial pressure, temperature, or the like of the metal chloride gas in the atmosphere of the reducing process. Since the metallic powder must be washed and recovered ordinarily after generating the metallic powder having a desired diameter, a cooling process of the metallic powder transferred from the reducing process, is necessary.

FIG. 1 is a conceptual diagram of a conventional reducing furnace used during the cooling process of the above-mentioned gas-phase reducing method. A lower part of FIG. 1 is a front view in which the reducing process part and the cooling process part are adjacently arranged, and an upper part of FIG. 1 is a plane view showing a luminous flame (flame resembling a burning flame of fuel gas such as LPG) in the reducing process part and a blowing direction (direction of four bold arrows in FIG. 1) of inert gas in the cooling direction. The reduction reaction is ordinarily performed at about 1000° C. or more. Therefore, the generated metallic powder particles may aggregate to form secondary particles during a period of cooling from the temperature of the reduction reaction to a temperature at which growth of the particles stop. To restrain generation of the secondary particles, it is necessary to rapidly cool faster than a certain cooling rate. However, as shown in FIG. 1, in a conventional rapid cooling method in which inert gas is introduced from plural parts of the cooling process part to the gas flow containing generated metallic powder, the gas flow containing the metallic powder is turbulent due to the inert gas for cooling. At this turbulent part, generated metallic powder is brought back to reducing process part side (upper side of FIG. 1), and the powder remains in the reducing process part for a long period. Therefore, the cooling rate is reduced, and as a result, metallic powder particles may aggregate to generate secondary particles, which are so-called "connected particles".

The inventors focused attention on the disruption of gas flow due to introduction of inert gas for cooling, and they found that fine metallic powder containing extremely few connected particles can be obtained by a cooling method by inert gas in which disruption of the gas flow in the reducing process part is restrained, and completed the invention. For example, as a reducing furnace corresponding to the present invention, as shown in FIG. 2, an aspect in which plural blowing directions (direction of four bold arrows in FIG. 2) of inert gas at the cooling process part are moved from a normal line of circumference surface of the cooling process part to the direction of the normal line to some extent and at the same time the blowing directions are moved to some extent in the horizontal direction, can be mentioned. Furthermore, as shown in FIG. 3, an aspect in which plural blowing directions (direction of four bold arrows in FIG. 3) of inert gas at the cooling process part are moved from a normal line of circumference surface of the cooling process part to the direction of the normal line to some extent and at the same time the blowing directions are not moved in the horizontal direction, can be mentioned.

If metallic powder adheres to an inner wall of the reducing process part and the cooling process part, the adhered powder stays in the reducing process for a long period and the powder is cooled at a low cooling rate, and as a result, the particles grow into coarse particles or particles adhere and aggregate to form secondary particles, and they are mixed in the finished product.

The inventors researched about a method to prevent mixing of the coarse particles by retarding adhesion of generated metallic powder to an inner wall of the producing device of the metallic powder. As a result, they found that sufficient effects can be obtained by always flowing inert gas continuously during the production of the metallic powder along the inner wall of the reducing furnace for the vertical direction, and have completed the invention. In the present invention, since adhering of the metallic powder to the inner wall of the production device is prevented, generation of the coarse particles can be prevented. In addition, compared to the conventional method in which production of the metallic powder is periodically stopped to remove adhering powder, reduction in production efficiency can also be reduced.

The method for production of metallic powder of the present invention was completed in view of the above-described situation, the method has a reducing process in which metal chloride gas and reducing gas are contacted to continuously to reduce the metal chloride, and a cooling process in which gas containing the metallic powder generated in the reducing process is cooled by inert gas, and wherein a vortex flow is formed by blowing out inert gas from at least one part around a flowing passage of the metallic powder during cooling process.

By the method for production of metallic powder of the present invention, a vortex flow is formed by blowing inert gas from at least one part, desirably from plural parts, around the flow passage of the metallic powder in the cooling process part. Therefore, the inert gas for cooling does not remain in the reducing process part, and uniform flow aspect of metallic powder can be realized at any position of the cooling process part. Therefore, growth of secondary particles due to aggregation of metallic particles conventionally generated at the part in which flow rate is low is reduced. The metallic powder containing few coarse particles such as aggregated particles can be reliably obtained.

In such a method for production of the metallic powder, it is desirable that the vortex flow be generated in a direction of vertically downward. The vortex flow vertically downward means that the blowing direction of the inert gas is inclined from the horizontal direction in a downward direction. In the case in which the vortex flow is generated vertically upward, a gas flow containing metallic powder flows in the vertical direction, the gas flow containing the metallic powder in the cooling furnace is disrupted by the inert gas for cooling during the rapid cooling. At the part in which the flow is disrupted, metallic powder is brought back to the reducing process part and the powder remains for a long period. In this period, the metallic powder particles may aggregate to generate secondary particles, so-called "connected particles". On the other hand, in the case in which the vortex flow is generated vertically downward, the remaining of the metallic powder for long periods in the reducing process part due to the disruption of the gas flow mentioned above is prevented, and generation of secondary particles by aggregation of the powder particles can be reduced. Therefore, in the present invention, metallic particles containing few coarse particles such as aggregated particles can be obtained more reliably.

In the method for production of the metallic powder of the present invention, it is desirable that blowing positions of the inert gas be arranged at more than four points and that each position be arranged at an equal interval. In this construction, the vortex flow can be generated almost uniformly at any position in the cooling furnace. That is, in the cooling process, there is no part in which the vortex flow is not generated locally. Therefore, in the present invention, metallic particles containing few coarse particles such as aggregated particles can be obtained further reliably.

In the method for production of the metallic powder of the present invention, it is desirable that the blowing direction of the inert gas be inclined from the horizontal direction downwardly at 5 to 25 degrees. In the case in which the inclined angle is less than 5 degrees, as shown in FIG. 1, there is almost no difference between the present invention and a conventional rapid cooling method in which inert gas is introduced from plural parts of lower part of the reducing furnace to the gas flow containing generated metallic powder. Therefore, the gas flow is disrupted during the rapid cooling, the generated powder is brought back to the reducing process part to remain for long periods, generating large numbers of secondary particles. In the case in which the inclined angle is more than 25 degrees, appropriate vortex flow cannot be generated even if inert gas blown out of plural blowing parts is intermixed. Therefore, the inert gas cannot play a role as a cooling medium. In the present invention having a structure as mentioned above, appropriate vortex flow can be generated in the flowing metallic powder. As a result, metallic particles containing few coarse particles such as aggregated particles can be obtained extremely reliably. Desirable vertical lengths of the vortex flow by the inert gas during the cooling process depends on the diameter of the reducing furnace, amount of metallic powder produced, and amount of inert gas supplied; however, it is determined that the metallic powder generated in the reducing furnace should be cooled to a temperature at least 200° C. lower than the reducing reaction temperature.

Furthermore, in the present invention, inert gas flow is always generated along the inner wall of the production device (reducing process and cooling process) in the vertical direction continuously during the production of the metallic powder to prevent adhering of the metallic powder on the inner wall of the production device.

Furthermore, the present invention provides a production device for the metallic powder in which vortex flow is generated by blowing out inert gas from at least one part around the flow passage of the metallic powder during the cooling process of the metallic powder. In addition, the present invention provides a production device of the metallic powder in which inert gas flow is always generated along the inner wall of the production device in the vertical direction continuously during the production of the metallic powder.

Desirable embodiments of the present invention are further explained by way of production examples and the figures. As a metallic powder which can be produced by the method of the present invention, other than one of nickel, metallic powder suitable for kinds of use such as paste filler of copper or silver, complex material of titanium material, or catalyst can be mentioned. Furthermore, a metallic powder of aluminum, titanium, chromium, manganese, iron, cobalt, platinum, bismuth, or the like can be produced.

In the present invention, first, metal chloride gas and reducing gas are contacted and reacted. A method to generate metal chloride gas can be selected from conventionally known methods. For example, a method in which solid metal chloride such as solid nickel chloride is heated and evaporated can be mentioned. Alternatively, a method in which metal chloride gas is continuously generated by contacting chlorine gas to a target metal can be mentioned. In the former method in which solid metal chloride is used as a raw material, it is difficult to generate gas stably since heating and evaporating (sublimation) operation is necessary. The partial pressure of the metallic chloride gas varies and the diameter of the metallic powder generated is unstable. Furthermore, since solid nickel chloride, for example, contains water of crystallization, dehydration pretreatment is necessary. If the dehydration is not performed sufficiently, the generated Ni powder may contaminated by oxygen. Therefore, the latter method in which metal chloride gas is continuously generated by contacting chlorine gas to a metal, is more desirable.

A. Chlorinating Process

FIG. 4 shows a production device of the metallic powder which is used to perform the method for production of the metallic powder of the present invention. It is desirable that the chlorinating process be performed by using a chlorinating furnace 10 shown in FIG. 4. A raw material supplying pipe 11 is arranged on an upper end surface of the chlorinating furnace 10.

A chlorine supplying pipe 12 is connected to one upper side part of the chlorinating furnace 10, and an inert gas supplying pipe 13 is connected to a lower side part below the upper side part. A heater 14 is arranged around the chlorination furnace 10, and a compound transferring pipe and nozzle 15 is connected to the other upper side part of the chlorinating furnace 10. The shape of the chlorinating furnace 10 is selected from, for example, the vertical type or the horizontal type, and the vertical type is more desirable to perform contact reaction of solid and gas uniformly. Chlorine gas is continuously introduced through the chlorine gas supplying pipe 12 while measuring the flowing amount of chlorine gas. The compound transferring pipe and nozzle 15 is connected to an upper end surface of a reducing furnace 20 mentioned below, and transfers nickel chloride gas or the like generated in the chlorinating furnace 10 to the reducing furnace 20. The lower part of the compound transferring pipe and nozzle 15 projects into the inside of the reducing furnace 20 to function as nickel chloride blowing nozzle. The condition of metallic nickel (M) as a raw material is not limited in particular, from the viewpoints of contact efficiency and prevention of pressure loss increase, a granular shape having a diameter from about 5 mm to 20 mm, an irregular shape, a placoid shape, or the like is desirable. The purity is desirably not less than 99.5%. The height of the metallic nickel (M) layer filled in the chlorinating furnace 10 can be determined in a range sufficient to convert chlorine gas to nickel chloride gas based on chlorine gas supplying rate, temperature inside the chlorinating furnace, continuous run length, shape of metallic nickel (M), or the like. The temperature inside the chlorinating furnace 10 is set at not less than 800° C. to promote the reaction sufficiently, and not more than 1483° C. which is the melting point of nickel. Considering the reaction rate and service life of the chlorinating furnace 10, a range from 900 to 1100° C. is desirable in practical use.

In the method for production of the metallic powder of the present invention, continuous supply of chlorine gas to the chlorinating furnace 10 filled with the metallic nickel (M) results to generate nickel chloride gas continuously. Furthermore, since the amount of nickel chloride gas generated depends on the amount of chlorine gas supplied, a reducing reaction explained below also depends on the amount of chlorine gas supplied, and as a result, the desired nickel powder product can be produced. An aspect of chlorine gas supplying is further described concretely as follows.

The nickel chloride gas generated in the chlorinating process is transferred by the compound transferring pipe and nozzle 15 to the reducing furnace 20. Alternatively, inert gas such as nitrogen or argon is supplied from 1 mol % to 30 mol % of the nickel chloride gas from the inert gas supplying pipe 13 and is mixed therewith, and this mixture gas is transferred to the reducing furnace 20. This supplying of the inert gas is a factor to control the particle diameter of the nickel powder. In the case in which an excess amount of inert gas is supplied, not only is the inert gas consumed in large amount, but it also causes energy loss. From such a viewpoint, desirable partial pressure of the nickel chloride gas in the mixture gas passing through the compound transferring pipe and nozzle 15 is in a range from 0.5 to 1.0 in the case in which the total pressure is 1.0. In particular, in the case in which nickel powder having a small particle diameter in a range from 0.2 μm to 0.5 μm is produced, partial pressure is desirably in a range from about 0.6 to 0.9. As explained, the generated amount of nickel chloride gas is freely controlled by the supplied amount of chlorine gas, and the partial pressure of the nickel chloride gas can also be freely controlled by the supplied amount of the inert gas.

B. Reducing Process

The nickel chloride gas generated in the chlorinating process is continuously transferred to the reducing furnace 20. It is desirable to perform the reducing process using the reducing furnace 20 shown in FIG. 4. The reducing furnace 20 shown in FIG. 4 is cylindrical and has an upper part in which reducing is performed and a lower part in which cooling is performed. A nozzle portion of the above-mentioned compound transferring pipe and nozzle 15 (hereinafter simply referred to as nozzle 15) is projected downward at the upper end part of the reducing furnace 20. Furthermore, a reducing gas supplying pipe (hydrogen supplying pipe) 21 is connected to the upper end surface of the reducing furnace 20. A heater 22 is arranged around the reducing furnace 20. The nozzle 15 transfers and blows nickel chloride gas (there is also a case in which inert gas is contained) from the chlorinating furnace 10 to the reducing furnace 20 at a desirable flow rate.

When the reducing reaction of nickel chloride gas and hydrogen gas is promoted, a luminous flame F, resembling the burning flame of a fuel gas such as LPG, which extends downwardly, is formed from a top part of the nozzle 15. The supplied amount of hydrogen gas in the reducing furnace 20 is the chemical equivalent of nickel chloride, that is, about 1.0 to 3.0 times larger than the chemical equivalent of chlorine gas supplied to the chlorinating furnace 10, and is desirably about 1.1 to 2.5 times; however, it is not limited to this range. However, in the case in which an excess amount of hydrogen is supplied, a large hydrogen flow is generated in the reducing furnace 20 and disrupts the flow of nickel chloride blown from the nozzle 15. As a result, the reducing reaction may be promoted non-uniformly, and this is not economical since the gas which is discharged is not being consumed. The temperature of the reducing reaction is set to a temperature high enough to complete the reaction, it is desirably not more than the melting point of nickel since solid nickel powder is easy to handle compared to that in the liquid state. From the viewpoint of reaction rate, durability of the reducing furnace 20, and cost, a range from 900 to 1100° C. is desirable in practical use, but it is not particularly limited.

As is described above, chlorine gas introduced into the chlorinating furnace 10 is converted to substantially the same mole amount of nickel chloride gas, which is a raw material used in the reduction. By controlling the linear velocity of the gas flow of the nickel chloride gas or the gas flow of the mixture gas of nickel chloride and inert gas blown out of the top of the nozzle 15, the particle diameter of nickel powder P obtained is appropriately controlled. That is, if the diameter of the nozzle is constant, by controlling the supplied amount of chlorine gas and inert gas to the chlorinating process, the particle diameter of nickel powder P generated in the reducing furnace 20 can be controlled within a target range. Desirable linear velocity of the gas flow at the top of the nozzle 15 is set in a range from about 1 m/s to 30 m/s at a reducing temperature in a range from 900 to 1100° C. In the case in which nickel powder having a small particle diameter such as from 0.1 μm to 0.3 μm is produced, the linear velocity is desirably in a range from about 5 m/s to 25 m/s, in the case in which nickel powder having a particle diameter of from 0.4 μm to 1.0 μm is produced, the linear velocity is desirably in a range from about 1 m/s to 15 m/s. Linear velocity of hydrogen gas in the axial direction of the reducing furnace 20 is desirably in a range from about 1/50 to 1/300 of the blowing rate (linear velocity) of nickel chloride gas, and more desirably in a range from 1/80 to 1/250. This is substantially like a condition in which nickel chloride gas is blasted from the nozzle 15 into a static hydrogen atmosphere. It is desirable that the direction of exit of the reducing gas supplying pipe 21 not be directed to the luminous flame F. As the reducing gas used to generate nickel powder, hydrogen gas, hydrogen sulfide or the like can be used; however, hydrogen gas is desirable from the viewpoint of effect on the nickel powder generated. A range of temperature of reducing reaction of metal chloride gas and reducing gas is ordinarily from 900 to 1200° C., desirably from 950 to 1100° C., and more desirably from 980 to 1050° C.

C. Cooling Process

As shown in FIG. 4, cooling process is performed in a space opposite to the nozzle 15 (lower part) in the reducing furnace 20. Furthermore, the cooling process can be performed separating containers of the reducing process and the cooling process, and connecting the reducing furnace 30 and the cooling cylinder 40 by nozzle 50 as shown in FIG. 5. However, from the viewpoint of prevention of aggregation of metallic powder, which is an object of the present invention, the cooling process is desirably performed soon after the reducing process as shown in FIG. 4. The cooling of the present invention is an operation to stop or retard growth of nickel particles in a gas flow (including hydrochloric acid gas) generated during the reducing reaction, and in practice, is an operation in which temperature at about 1000° C. in the gas flow after the reducing reaction is rapidly cooled to about 400 to 800° C. The cooling can be performed to a temperature less than this range.

As a desirable example of the cooling, this embodiment has a structure in which inert gas is blown to a lower space at the top of the luminous flame F. That is, in FIG. 4, nitrogen gas is blown from cooling gas supplying pipe 23 to cool the gas flow. By blowing inert gas, aggregation of nickel powder P can be prevented and at the same time the diameter can be controlled. In practice, the plural cooling gas supplying pipes 23 are connected around the flowing direction (vertically downward in FIG. 4) of nickel powder P (peripheral wall of the cooling process part of the reducing furnace 20 in FIG. 4) at equal intervals. The cooling gas supplying pipe 23 is inclined to some extent from the normal line of peripheral surface of the cooling process part, and the blowing direction is also inclined from the horizontal direction downwardly to some extent. In this construction, inert gas blown from these cooling gas supplying pipes 23 generates a vortex flow. Therefore, cooling conditions can be freely changed to control particle diameter more accurately. Furthermore, by generating the vortex flow in the vertically downward direction, by arranging not less than four inert gas blowing points at equal intervals, or by inclining the blowing direction of inert gas at 5 to 25 degrees downward, metallic powder containing few coarse particles such as aggregated particles can be obtained more reliably. As shown in FIG. 6, by arranging cooling gas supplying pipe 24 below the cooling gas supplying pipe 23 in the similar arranging aspect, cooling process can be performed in two steps. As a result, metallic powder containing few coarse particles such as aggregated particles can be obtained even more reliably compared to embodiment shown in FIG. 4. The inert gas used to rapidly cool the metallic powder is not limited as long as it does not affect the metallic powder, and nitrogen gas, argon gas, or the like can be desirably used. In particular, nitrogen gas is desirable since it is inexpensive. The amount of inert gas supplied to cool the metallic powder after the reducing process is ordinarily not less than 5 Nl/min per 1 g of metallic powder, desirably in a range from 10 to 50 Nl/min. The temperature of the inert gas is ordinarily in a range from 0 to 100° C., and desirably in a range from 0 to 80° C.

As explained above, by cooling the nickel powder soon after the reducing reaction, growth of nickel powder particles and generation of secondary particles by aggregation can be reduced, and the particle diameter of the nickel powder can be controlled certainly. As a result, metallic powder containing few coarse particles such as aggregated particles to meet the requirements of thinner layers and a greater number of layers for recent capacitors (for example, particle diameter 1 μm) can be reliably obtained.

In the reducing process and the cooling process, it is more effective that inert gas flow be generated from inert gas blowing nozzle 26 in a vertical direction along the inner wall of the production device. The inert gas flow in the vertical direction along the inner wall of the production device is generated from at least one point of the inner wall, desirably from plural points. The amount of inert gas supplied is 0.1 to 10 m/s at this time.

D. Recovery Process

A gas mixture containing nickel powder P, hydrochloric acid gas, and inert gas generated and cooled through the reducing process and the cooling process is transferred to a recovery furnace (not shown) via a nozzle 15 shown in FIG. 4, nickel powder P is separated and recovered from the gas mixture there. To recover the nickel powder, for example, one or more methods selected from one employing a bag filter, a recovery method in water, a recovery method in oil, and magnetic recovery method can be performed; however, this is not limited to these methods. Furthermore, the nickel powder can be washed with water or a primary alcohol having a carbon number of 1 to 4 before or after recovery, if necessary.

EXPLANATION OF REFERENCE NUMERALS

10 . . . Chlorinating furnace, 20 . . . Reducing furnace, 30 . . . Reducing furnace, 40 . . . Cooling cylinder

BEST MODE FOR CARRYING OUT THE INVENTION

The effect of the present invention is further explained by way of Examples and the figures.

EXAMPLE 1

Figure 4:
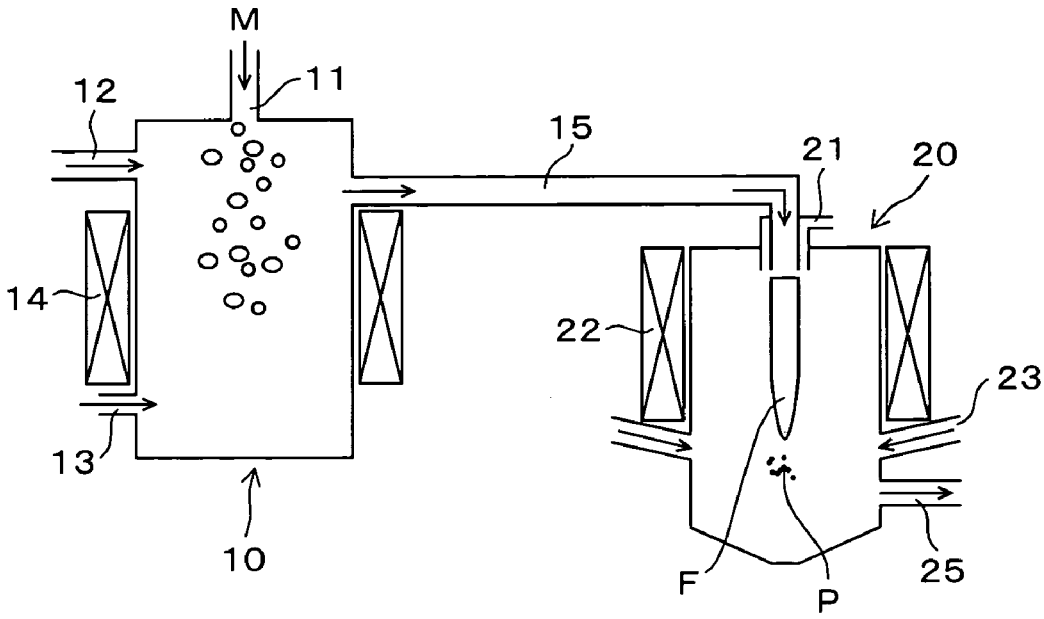
FIG. 4 is a diagram showing a production device for metallic powder in an embodiment of the present invention.
Figure 5:
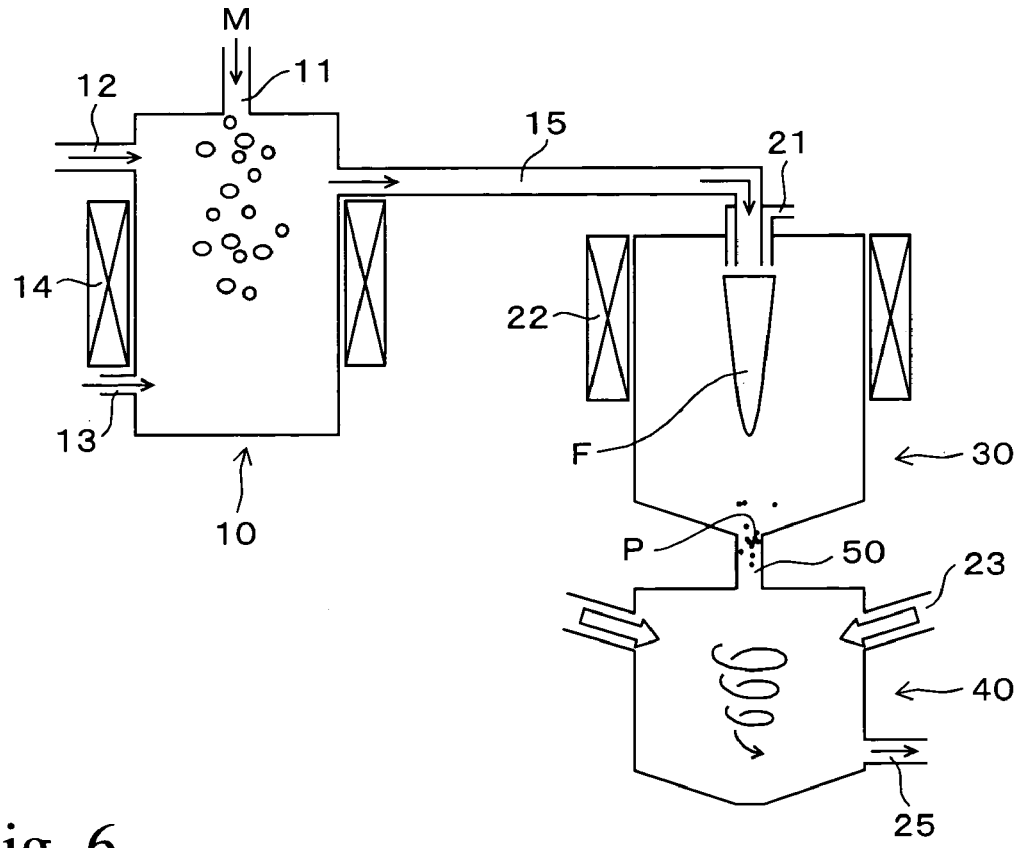
FIG. 5 is a diagram showing a production device for metallic powder in another embodiment of the present invention.

First, as a chlorinating process, raw material nickel powder M was filled in chlorinating furnace 10 of a production device of metallic powder shown in FIG. 4 through a raw material supplying pipe 11 arranged on upper end surface of the chlorinating furnace 10, and temperature of atmosphere in the furnace was raised to 1100° C. by a heater 14. Next, chlorine gas was supplied to the chlorinating furnace 10 through a chlorine gas supplying pipe 12 to chlorinate the metal nickel to generate nickel chloride gas. 10 mol % amount of the chlorine gas of nitrogen gas was supplied to the chlorinating furnace 10 through an inert gas supplying pipe 13. The gas mixture of chlorine gas and nitrogen gas was introduced to a reducing furnace 20 through a nozzle 15.

Next, as a reducing process, the gas mixture of nickel chloride and nitrogen was introduced into the reducing furnace 20 having a temperature at the inner atmosphere of 1000° C. by heating with a heater 22, through the nozzle 15 at a flow rate of 2.3 m/s (converted at 1000° C.). At the same time, hydrogen gas was introduced into the reducing furnace 20 through a reducing gas supplying pipe 21 attached on the upper end surface at a flow rate of 0.02 m/s to reduce nickel chloride and to obtain nickel powder P. When the reducing reaction of nickel chloride gas and hydrogen gas was promoted, a luminous flame F resembling a burning flame of gas fuel such as LPG, was observed from the top part of the nozzle 15.

Figure 2:
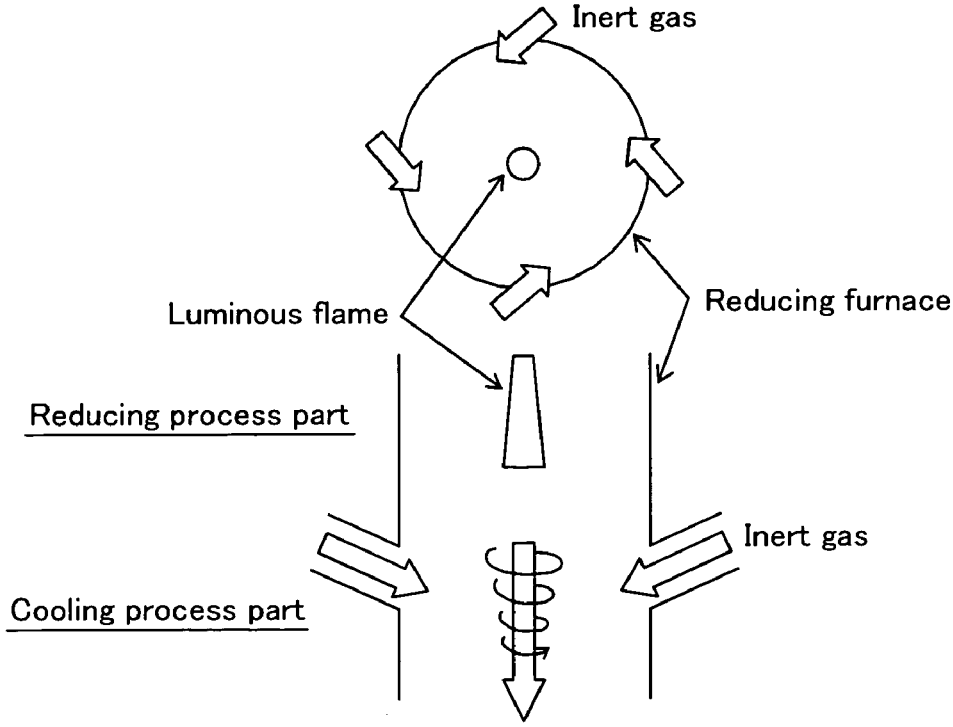
FIG. 2 is a conceptual diagram showing a reducing furnace in an embodiment of the present invention.
Figure 3:
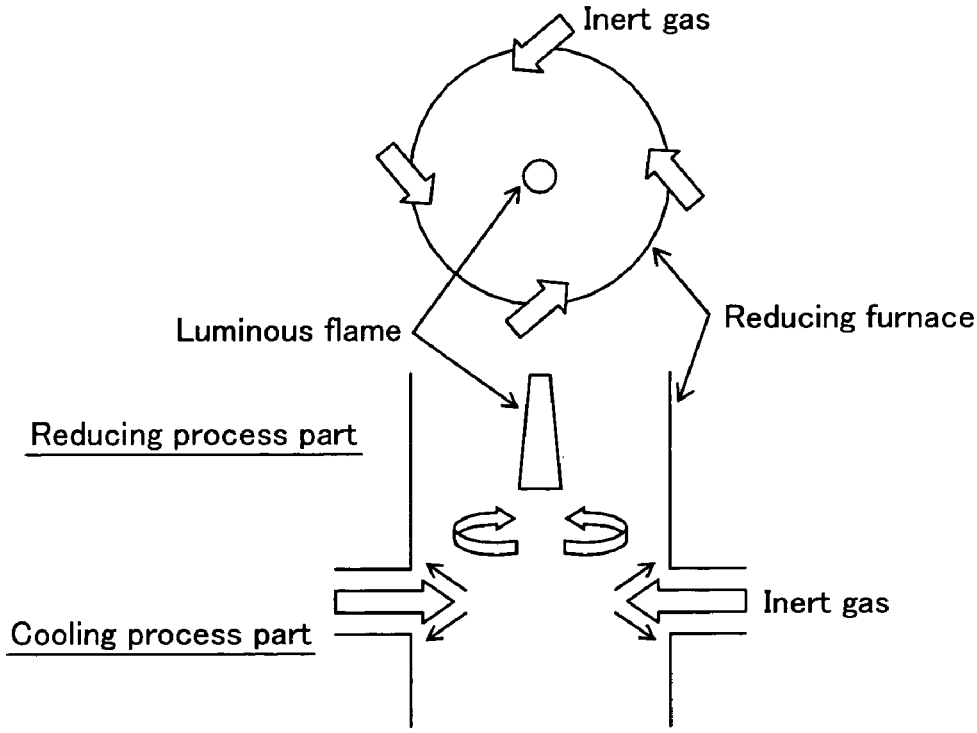
FIG. 3 is a conceptual diagram showing a reducing furnace in another embodiment of the present invention.

After the reducing process, as a cooling process, nitrogen gas was supplied to cool the nickel powder P through a cooling gas supplying pipe 23 arranged at a lower side part of the reducing furnace 20 at 16.4 Nl/min/g. At this time, nitrogen gas was blown at the luminous flame F in an aspect shown in FIG. 2 mentioned above. Generated nickel powder P, nitrogen gas, and hydrochloric acid gas were introduced to a recovery furnace (not shown in the figures) through a nozzle 25.

Figure 8:
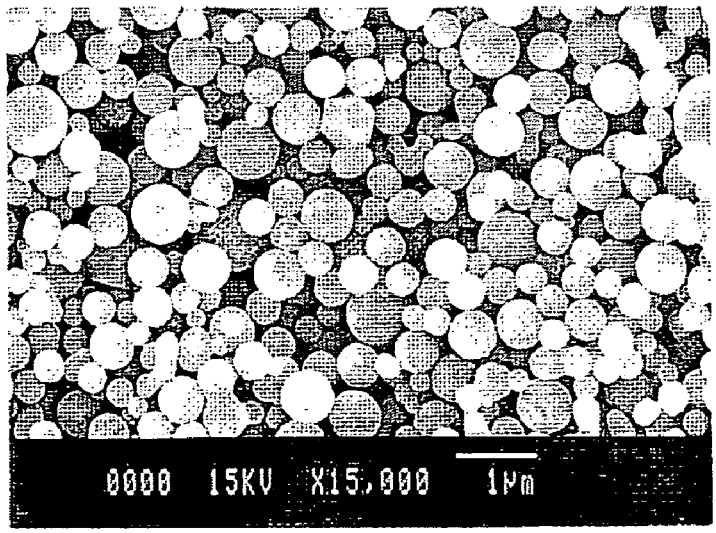
FIG. 8 is an SEM photograph showing nickel powder obtained in Example 1.

Next, nitrogen gas, hydrochloric acid gas, and nickel powder P which were introduced to the recovery furnace through the nozzle 25, were introduced into a bag filter (not shown in the figures), to separate and recover the nickel powder P. After that, the nickel powder P was washed with hot water and dried to obtain a finished product of nickel powder. An SEM photograph of nickel powder obtained in Example 1 is shown in FIG. 8. As is clear from FIG. 8, this nickel powder contains few coarse particles and connected particles (secondary particles).

EXAMPLE 2

Figure 6:
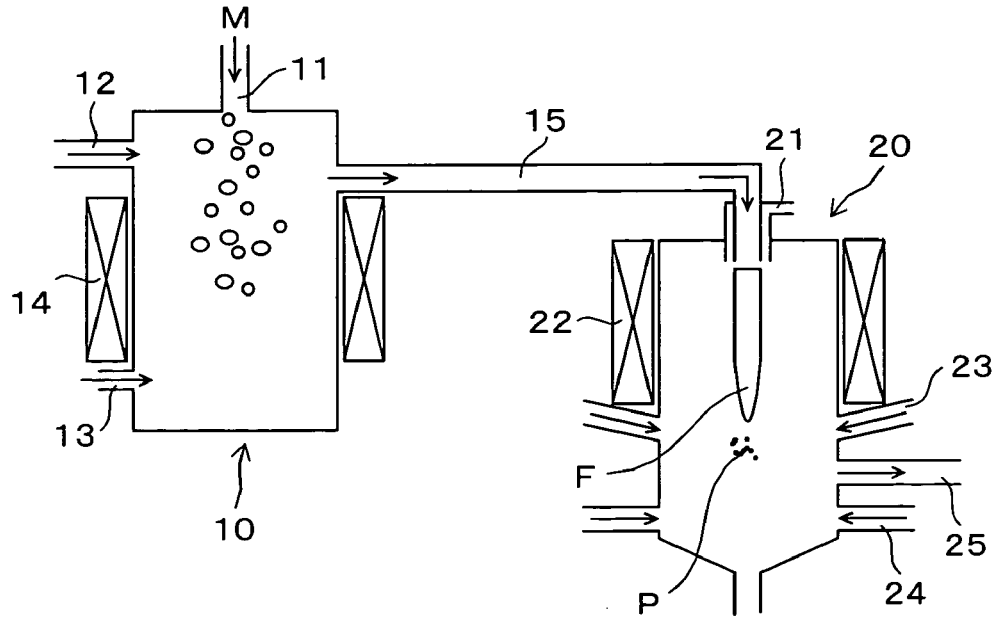
FIG. 6 is a diagram showing a production device for metallic powder in another embodiment of the present invention.
Figure 9:
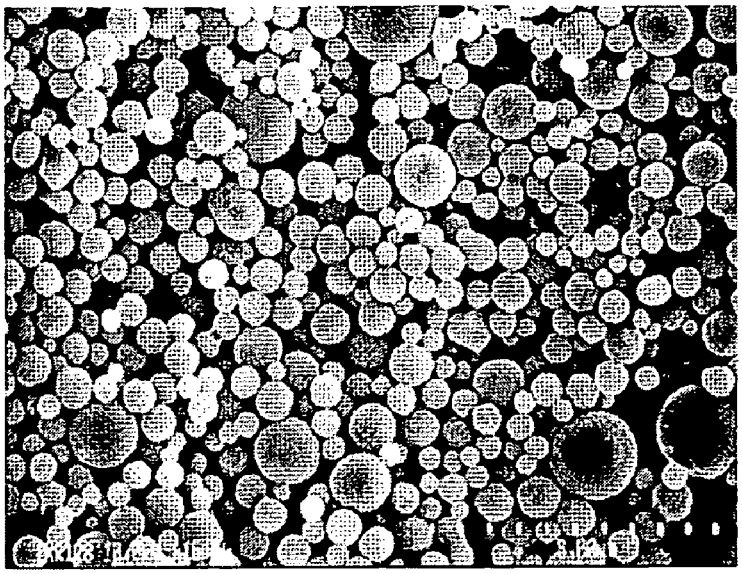
FIG. 9 is an SEM photograph showing nickel powder obtained in Example 2.

The nickel powder P was produced in a manner similar to that in Example 1, the cooling process was performed as shown in FIG. 6, and the supplied amount of nitrogen gas was 8.2 Nl/min/g. The blowing direction of nitrogen gas to the luminous flame F was similar to Example 1, that is, the aspect shown in FIG. 2. Furthermore, as a secondary cooling process, nitrogen gas was further supplied from a secondary cooling gas supplying pipe 24 arranged below the cooling gas supplying pipe 23 at 8.2 Nl/min/g to contact with the nickel powder, to perform two-step cooling process. Next, the powder was recovered, washed, and dried in a manner similar to that as in Example 1 to obtain a finished product of nickel powder. An SEM photograph of nickel powder obtained in Example 2 is shown in FIG. 9. This nickel powder contains fewer coarse particles and connected particles (secondary particles) than the nickel powder of Example 1.

EXAMPLE 3

Figure 7:
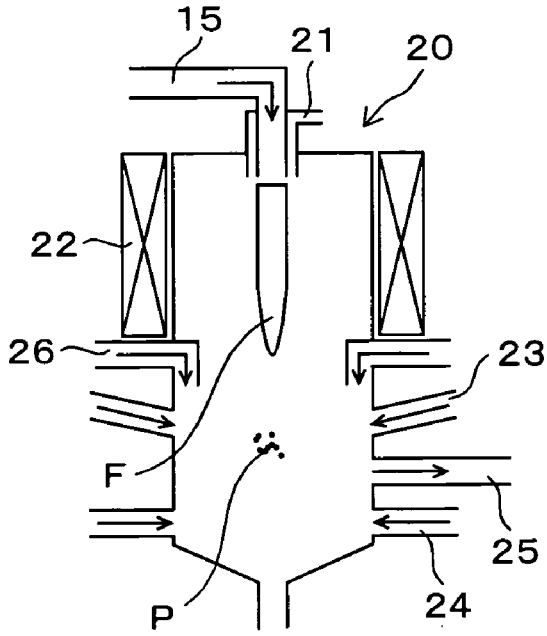
FIG. 7 is a diagram showing a reducing furnace for metallic powder in another embodiment of the present invention.

The nickel powder was produced in a manner similar to that in Example 2, except for using the reducing furnace shown in FIG. 7, except for blowing nitrogen gas continuously at 2.0 m/s from inert gas blowing nozzle 26 in the vertical direction along the inner wall of the reducing furnace to generate gas flow. This nickel powder contains fewer coarse particles and connected particles (secondary particles) than the nickel powder of Example 2.

COMPARATIVE EXAMPLE

Figure 1:
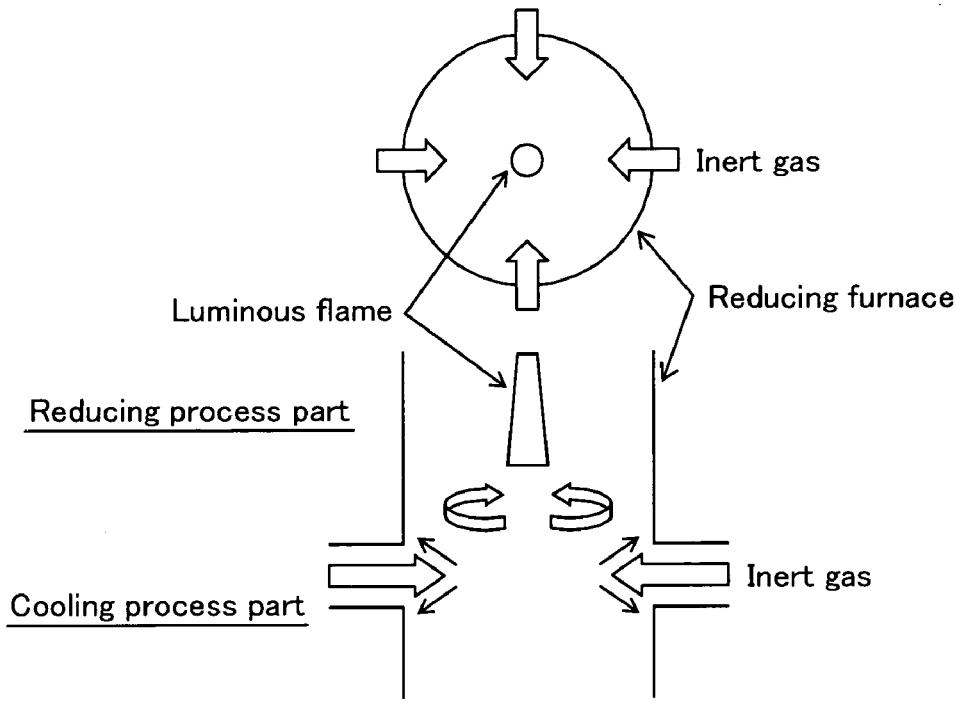
FIG. 1 is a conceptual diagram showing a conventional reducing furnace.
Figure 10:
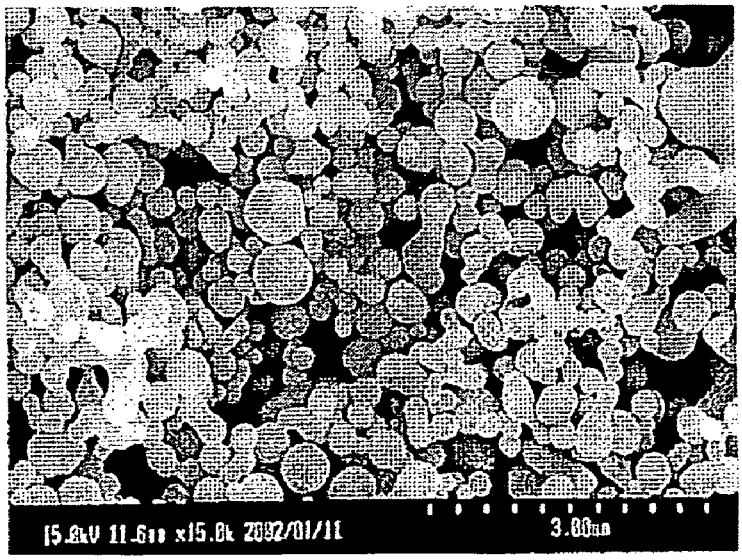
FIG. 10 is an SEM photograph showing nickel powder obtained in Comparative Example.

The nickel powder was produced in a manner similar to that as in Examples 1 and 2, except for using the device shown in FIG. 4 and supplying nitrogen gas 16.4 Nl/min/g through the cooling gas supplying pipe 23. At this time, nitrogen gas was blown into the luminous flame F in an aspect shown in FIG. 1 mentioned above. Generated powder was recovered, washed, and dried in a manner similar to that in Examples 1 and 2. An SEM photograph of nickel powder obtained in the Comparative Example is shown in FIG. 10. As is clear from FIG. 10, this nickel powder contains more coarse particles and connected particles (secondary particles) than the nickel powder of the Examples. The numbers of coarse particles and connected particles in the nickel particles of Examples, and Comparative Example are shown in Table 1.

TABLE 1

| | Number of coarse particles (2 to 5 μm) | Number of connected particles (1 to 2 μm) |
|---|---|---|
| Example 1 | 19 | 399 |
| Example 2 | 18 | 278 |
| Example 3 | 15 | 143 |
| Comparative Example | 23 | 503 |

As shown in Table 1, each Examples contains fewer coarse particles and connected particles than Comparative Example. In particular, the number of connected particles in each Example is extremely small compared to Comparative Example. Therefore, the nickel powders of Examples are appropriate as a raw material of recent capacitors in which thinner layers and a greater number of layers are required.

As explained above, in the method for production of the metallic powder of the present invention, since the vortex flow is generated by blowing inert gas from plural parts around the flow passage of the metallic powder during a cooling process, growth of generated metallic powder particle to secondary particle by aggregation after the reducing process can be certainly reduced. Therefore, the present invention is useful from the viewpoint of production of raw materials of recent capacitors in which thinner layers and a greater number of layers are required.

The invention claimed is:

1. The method for production of metallic powder, the method comprising:

reducing metal chloride continuously by a reducing process by contacting metal chloride gas and reducing gas, and cooling metallic powder generated by the reducing process by inert gas continuously, wherein the inert gas is blown from one or more parts around a flow passage of the metallic powder to generate a vortex flow in the vertically downward direction.

2. The method for production of metallic powder according to claim 1, wherein the parts from which inert gas is blown are not less than four at equal intervals.

3. The method for production of metallic powder according to claim 1, wherein the blowing direction of inert gas is inclined at 5 to 25 degrees from the horizontal direction.

4. The method for production of metallic powder according to claim 1, wherein the supplied amount of the inert gas is 5 Nl/mm per 1 g of the metallic powder.

5. The method for production of metallic powder according to claim 1, wherein the temperature of the inert gas is set at from 0 to 100° C.

6. The method for production of metallic powder according to claim 1, wherein the metal chloride gas is generated by contacting chlorine gas continuously with solid metal, or by heating and evaporating solid metal chloride.

7. The method for production of metallic powder according to claim 1, wherein each blowing direction of the inert gas from the one or more parts is inclined from a normal line of a circumference surface of the flow passage of the metallic powder to some extent in the horizontal direction and is also inclined from the normal line to some extent in the vertical direction.

8. The method for production of metallic powder according to claim 1, wherein each blowing direction of the inert gas from the one or more parts is inclined from a normal line of a circumference surface of the flow passage of the metallic powder to some extent in the horizontal direction and is not inclined from the normal line in the vertical direction.

9. The method for production of metallic powder according to claim 1, wherein reducing the metal chloride continuously and cooling the metallic powder generated by the reducing process are both performed in a single reduction furnace.

10. The method for production of metallic powder according to claim 1, wherein the vortex flow is generated uniformly at any position within a cooling process part of the flow passage.

11. The method for production of metallic powder according to claim 10, wherein the inert gas is blown from a plurality of parts around the flow passage.

12. The method for production of metallic powder according to claim 1, wherein reducing the metal chloride continuously and cooling the metallic powder generated by the reducing process are both performed in a single reduction furnace. according to claim 11, wherein the plurality of parts are arranged at equal intervals around the flow passage.

13. The method for production of metallic powder according to claim 12, wherein each blowing direction of the inert gas from the plurality of parts is inclined from a normal line of a circumference surface of the flow passage of the metallic powder to some extent in the horizontal direction and is not inclined from the normal line in the vertical direction.

14. The method for production of metallic powder, the method comprising:

reducing metal chloride continuously by a reducing process by contacting metal chloride gas and reducing gas, conducting a first cooling process comprising cooling metallic powder generated by the reducing process by inert gas continuously, wherein the inert gas is blown from one or more parts around a first portion of a flow passage of the metallic powder to generate a vortex flow, and conducting a secondary cooling process comprising further cooling the metallic powder cooled by the first cooling process by inert gas continuously, wherein the inert gas is blown from one or more parts around a second portion of a flow passage of the metallic powder downstream of the first portion to generate a vortex flow.

15. The method for production of metallic powder according to claim 14, wherein, in the secondary cooling process, the parts from which inert gas is blown are not less than four at equal intervals.

16. The method for production of metallic powder according to claim 14, wherein, in the secondary cooling process, the blowing direction of inert gas is inclined at 5 to 25 degrees from the horizontal direction.

17. The method for production of metallic powder the temperature of according to claim 14, wherein, in the secondary cooling process, the supplied amount of the inert gas is 5 Nl/mm per 1 g of the metallic powder.

18. The method for production of metallic powder according to claim 14, wherein, in the secondary cooling process, the temperature of the inert gas is set at from 0 to 100° C.

19. The method for production of metallic powder according to claim 14, wherein reducing the metal chloride continuously, the first cooling process and the secondary cooling process are all performed in a single reduction furnace

20. The method for production for metallic powder, the method comprising:

reducing metal chloride continuously by a reducing process by contacting metal chloride gas and reducing gas in a reducing furnace, and cooling metallic powder generated by the reducing process by inert gas continuously, wherein the inert gas is blown from one or more parts around a flow passage of the metallic powder to generate a vortex flow and wherein inert gas flow is generated in a downward direction along the inner wall of the reducing furnace continuously during the production of the metallic powder.

21. The method for production of metallic powder, the method comprising:

reducing metal chloride continuously by a reducing process by contacting metal chloride gas and reducing gas, conducting a first cooling process comprising cooling metallic powder generated by the reducing process by inert gas continuously, wherein the inert gas is blown from one or more parts around a flow passage of the metallic powder to generate a vortex flow, and conducting a secondary cooling process comprising further cooling the metallic powder cooled by the first cooling process by inert gas continuously, wherein the inert gas is blown from one or more parts around a flow passage of the metallic powder to generate a vortex flow in the vertically downward direction.

* * * * *